US006003438A

United States Patent [19]

Schwede

[11] Patent Number: 6,003,438

[45] Date of Patent: Dec. 21, 1999

[54] LOOPING MACHINE FOR THE LOOPING OF OBJECTS COMPRISING DEVICE FOR TENSIONING IN DEPENDENCE ON THE HEIGHT OF AN OBJECT

[75] Inventor: Roland Schwede, Goldkronach, Germany

[73] Assignee: SMB Schwede Maschinenbau GmbH, Goldkronach, Germany

[21] Appl. No.: 09/082,156

[22] Filed: May 21, 1998

[30] Foreign Application Priority Data

May 27, 1997 [DE] Germany ..... 197 22 066

[51] Int. Cl.[6] ..... B65B 13/22

[52] U.S. Cl. ..... 100/4; 53/66; 53/589; 100/26; 100/32

[58] Field of Search ..... 100/4, 26, 29, 100/32, 33 PB; 53/66, 589

[56] References Cited

U.S. PATENT DOCUMENTS

| | | | |
|---|---|---|---|
| 3,294,012 | 12/1966 | Kobiella | 100/4 |
| 3,588,480 | 6/1971 | Unger | 702/156 |
| 4,785,731 | 11/1988 | Nguyen | 100/4 |
| 5,111,634 | 5/1992 | Rauch | 53/589 |
| 5,138,817 | 8/1992 | Mowry et al. | 53/399 |
| 5,333,438 | 8/1994 | Gurak et al. | 100/26 |
| 5,460,359 | 10/1995 | Toyohara et al. | 100/4 |
| 5,791,238 | 8/1998 | Garbotz | 100/32 |
| 5,809,873 | 9/1998 | Chak et al. | 100/4 |

FOREIGN PATENT DOCUMENTS

| | | |
|---|---|---|
| 0620528 | 10/1994 | European Pat. Off. . |
| 12 72 813 | 7/1968 | Germany . |
| 34 43 694 | 6/1986 | Germany . |
| 37 00 146 | 7/1988 | Germany . |
| 42 19 355 | 12/1993 | Germany . |
| 44 06 525 | 9/1995 | Germany . |
| 195 05 509 | 8/1996 | Germany . |
| 196 12 464 | 3/1997 | Germany . |
| 8-301250 | 11/1996 | Japan . |

*Primary Examiner*—Stephen F. Gerrity
*Attorney, Agent, or Firm*—Browdy and Neimark

[57] ABSTRACT

A looping machine for the looping of objects such as stacks of products, packages and the like, is provided with a machine frame, a work table, a strap guiding frame disposed on the work table for fitting a looping strap as a loose loop around the object to be looped which is disposed on the work table within the strap guiding frame, an insertion device for inserting the looping strap into the strap guiding frame, a withdrawal device for withdrawing the looping strap from the strap guiding frame and for fitting the strap around the object to be looped, a tensioning device for tightening the looping strap around the object, and height detection device for the object to be looped. This height detection device comprises a sensor of non-contact operation for detecting the object height, a control unit coupled therewith for the tensioning device for adjusted tensioning in dependence on the object height, and a memory unit for storing at least one characteristic function of tensioning in dependence on the object height, the control unit accessing the characteristic function in the memory unit for adjusted tensioning.

19 Claims, 3 Drawing Sheets

LOOPING MACHINE FOR THE LOOPING OF OBJECTS COMPRISING DEVICE FOR TENSIONING IN DEPENDENCE ON THE HEIGHT OF AN OBJECT

BACKGROUND OF THE INVENTION

1. Field of the Invention

The invention relates to a looping machine for the looping of objects such as stacks of newspapers, magazines or any other stacked goods such as packages, for instance cardboxes and the like.

2. Background Art

A looping machine for this purpose is described for instance in the co-pending U.S. patent application Ser. No. 08/785,129 (now U.S. Pat. No. 5,791,238). In addition to the components notoriously present in these equipments, namely a machine frame, work table, strap guiding frame for guiding the strap as a loose loop around the object to be looped, an insertion device for inserting the strap into the strap guiding frame and a withdrawal device for withdrawing the strap from the strap guiding frame and for slinging the strap around the object to be looped, this looping machine also comprises a device for tensioning the looping strap around the object in dependence on the height of a stack. Tensioning in dependence on the height of a stack is of advantage in this connection, since the looping strap must bundle the stack tightly, but tensioning must be the stronger, the softer, i.e. the more compressible, the goods are that form the stack. As a rule, the compressibility of a stack increases with the height of the stack and the number for instance of newspapers in a stack growing. This means that strong tensioning must be ensured in the case of a high stack, whereas virtually no tensioning may occur in the case of very low stacks or when a single newspaper is looped, since this would lead to the paper coiling up.

In the tensioning device according to the prior patent application mentioned above, a complicated mechanical construction is provided for adjusted tensioning in dependence on the height of a stack. A pivotal rocker lever is available, which comprises a control ramp and is adjustable by way of a mechanical device detecting the height of a stack by touch contact. This mechanical touch contact device is for instance a leverage mechanism disposed between the pressing beam which compresses the stack to be looped before the looping strap is fitted around, and the pivotal rocker lever which has a control ramp. The latter actuates a control lever for a clamping lever which is pivotally articulated to the tension lever of the tensioning device, this tension lever producing the tensioning effect. The control lever controls the clamping lever in such a way that when the height of a stack decreases, blocking of the clamping device for fixing the strap is increasingly retarded and the tensioning length of the looping strap is reduced.

In addition to the high mechanical requirements, the known tensioning device has further drawbacks. For instance, the tensioning effect is only varied by adjustment of the tensioning length. Furthermore, only a proportional dependence between the product height and the tensioning length is attainable so that more complex dependencies are not achievable.

SUMMARY OF THE INVENTION

Proceeding from these problems, it is an object of the invention to embody a looping machine which allows tensioning in dependence on the height of an object and in which reduced mechanical requirements are accompanied with higher flexibility in the tensioning adjustment in dependence on the object.

This object is attained by a looping machine according to the invention, in which a height detection device is provided for the object to be looped. It comprises a sensor of non-contact operation for scanning the height of an object. Coupled with the sensor is a control unit, by means of which to adjust the tensioning device for proper tensioning. This control device can for instance be a time control which activates a pair of looping-strap-driving rollers for a certain time, thus contracting the looping strap by a certain tensioning length. The control unit may as well be a motor control for an adjustable speed d.c. motor which, by the aid of the control tautens the strap by applying a certain tensioning force. Tensioning by applying a certain force can also be realized by the aid of an electronically adjustable torque coupling which is releasable when a certain electronically adjustable tensioning force has been reached.

The flexibility envisaged in the object of the invention is attained by a memory unit further provided according to the invention, which serves for storing a characteristic function of tensioning in dependence on the height of an object. For adjusted tensioning, the control unit accesses this characteristic function in the memory unit.

By way of a corresponding concept of the characteristic function, tensioning can be adjusted virtually arbitrarily and adapted to the respective requirements of the objects to be looped. Consequently, a looping machine according to the invention can be fitted to comply with varying specifications of customers by corresponding selection of the characteristic function.

As outlined, according to preferred embodiments of the invention, the tensioning length of the looping strap as well as the tensioning force can be defined as parameters in the characteristic function. This depends primarily on the type of control unit used for the tensioning device and on the latter itself.

Furthermore, the characteristic function can be a continuous function. This ensures continuously variable tensioning adjustment in dependence on the height of an object. In this case, provision must be made for comparatively precise resolution of the sensor and tensioning adjustability of the tensioning device in order that it be possible to make use of the characteristic function in the form of a continuous characteristic curve and to translate its precision into practice.

For practical reasons, the characteristic function will preferably be a step function. This means that for certain ranges of height of an object, looping takes place at a fixed value of the tensioning length or force. In this case, there is no absolute need for the sequence of steps to ascend or descend continuously, should this be necessary from practical aspects.

Advantageously, the sensor is an ultrasonic sensor disposed in the upper horizontal stretcher of the strap guiding frame, from where it scans the height of the object passing below.

An advantageous embodiment of the looping machine according to the invention relates to an interface for the transmission to external equipments of a signal representative of the height of an object and obtained by the aid of the height detection device. In this way, when the looping machine is incorporated in a packaging line, the height detection device, which is integrated in the looping machine, can be used also for further handlings of the object, for instance for the control of a printing head of non-contact operation during subsequent inscription on the top side of the object.

Furthermore, provision is made for the height detection device to be coupled with the withdrawal device, as a result of which the controlled withdrawal of the looping strap can be adapted to the height of an object. In terms of the time needed for the withdrawal job, this helps attain a considerable advantage as opposed to the prior art which provides to transport the looping strap, for its withdrawal from the strap guiding frame, by means of a pair of rolls for a constant period regardless of the height of an object. In the case of very high objects, the strap will fit around the object at a rather early stage during the withdrawal cycle so that the remaining transporting time of the withdrawal device is "given away" as it were. In the case of height detection of the object and corresponding adaptation of the withdrawal time, the proper tensioning process can take place directly afterwards so that the cycle time needed for a looping operation is optimally adapted to the height of the object.

In keeping with another preferred embodiment, object recognition is feasible by means of the height detection device. When translated into practice, this means that the sensor recognizes for instance the form of the top side, turned towards it, of the object and can compare the corresponding coordinates with stored coordinates of a certain object, thus recognizing the object. On this basis, a characteristic function allocated to this object can be selected and corresponding tensioning can take place.

Further features, details and advantages of the invention will become apparent from the ensuing description of an exemplary embodiment of the subject matter of the invention, taken in conjunction with the enclosed drawings.

DESCRIPTION OF THE PREFERRED EMBODIMENT

Figure 1:
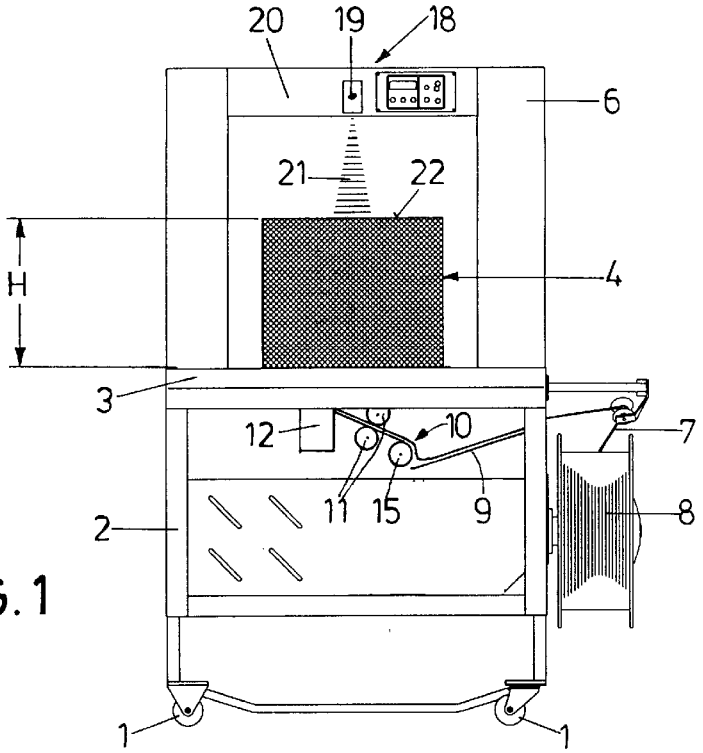
FIGS. 1 and 2 are diagrammatic lateral views of a looping machine with objects of varying height positioned on the work table.
Figure 2:
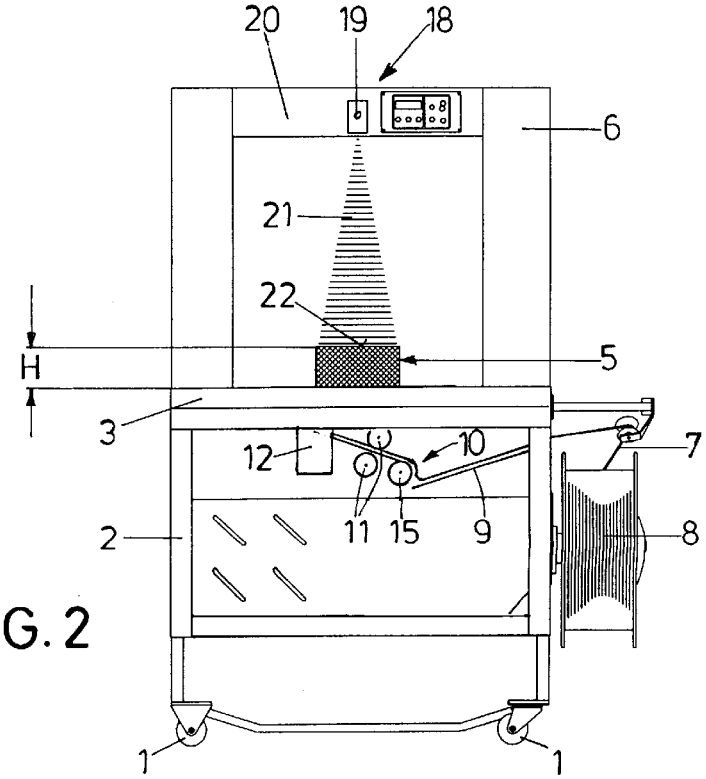

As seen in FIGS. 1 and 2, the looping machine comprises a machine frame 2 which is mounted on rollers 1 and on which a work table 3 is arranged. The work table 3 comprises conveyor belts (not shown) by means of which the objects to be looped—for instance a stack of newspapers 4 in FIG. 1 or a cardbox 5 in FIG. 2—are conveyed into the position for looping on the work table 3. For so-called crosswise looping, a rotary table may additionally be integrated in the work table 3, as can be seen in U.S. Pat. No. 5,111,634.

Disposed on the work table 3 is a vertical strap guiding frame 6, by the aid of which the looping strap 7 can be guided as a loose loop around the object 4, 5 on the work table 3. To this end, the looping strap supplied from a supply coil 8 by the side of the machine frame 2 is led by guides 9 (only diagrammatically outlined) via a tensioning device 10 and a pair of driving rollers 11 through the welding head 12 of the looping machine and to the strap guiding frame 6. For the insertion of the strap 7, the pair of driving rollers 11 is set to rotate in the corresponding direction and the strap 7 is led around in the strap guiding frame 6 until its free end takes its place in the vicinity of the welding head 12, where it is fixed. Then the pair of driving rollers 11 is activated in the reverse direction. As a result, the looping strap 7 is withdrawn from the strap guiding frame 6, i.e. it leaves the strap guiding frame 6 and fits as a loop around the object 4, 5 to be looped. Consequently, the pair of driving rollers 11, together with its drive motor 13 and the motor control 14, serves as a joint insertion and withdrawal device for the looping strap 7 (FIG. 3).

Figure 3:
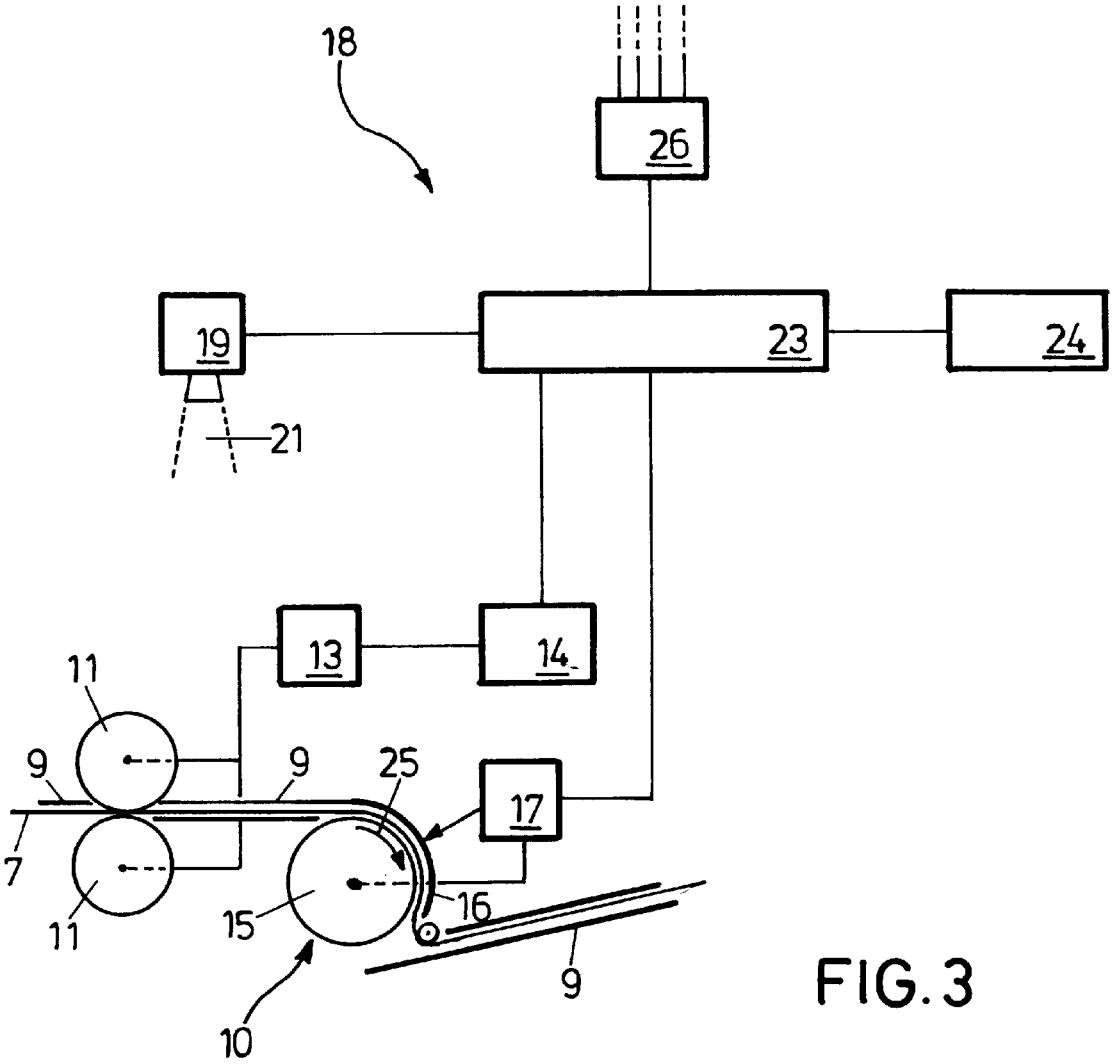
FIG. 3 is a block diagram of the height detection device of the looping machine according to FIGS. 1 and 2.

The tensioning device 10 diagrammatically illustrated in FIGS. 1 to 3 comprises a rubberized tightening roller 15 which cooperates with a curved guide rail 16. The latter ensures an angle of contact of the looping strap 7 around the tightening roller 15 of approximately 90° and close frictional contact between the tightening roller 15 and the looping strap 7. In this way, by rotation of the tightening roller 15 by the aid of its drive motor 17, high tensile load can be applied for tensioning the strap 7 around the object 4, 5 to be looped.

For tensioning in dependence on the height of the object 4, 5 to be looped to be feasible, a height detection device 18 is further provided on the looping machine, the structure of which is diagrammatically outlined in FIG. 3. This device 18 possesses an ultrasonic sensor 19 of non-contact operation, which is disposed centrally on the upper horizontal stanchion 20 of the strap guiding frame 6. Its lobar measuring field 21 is directed vertically downwards in the direction towards the work table 3, thus detecting the top side 22 of the objects 4, 5 to be looped. Based on the distance, depending on the height, of the top side 22 from the ultrasonic sensor 19, the latter can produce a signal which is representative of the height of the object 4, 5 to be looped and which can be processed by the control unit 23 for the tensioning device 10. To this end, the control unit 23 accesses a memory unit 24 in which one or several characteristic functions for the tensioning of the looping strap 7 in dependence on the object height H are stored. The control unit 23 and the memory unit 24, together with the motor control 14—and of course further machine control groups—can be realized on the basis of a stored program control or microprocessor control.

Figure 4:
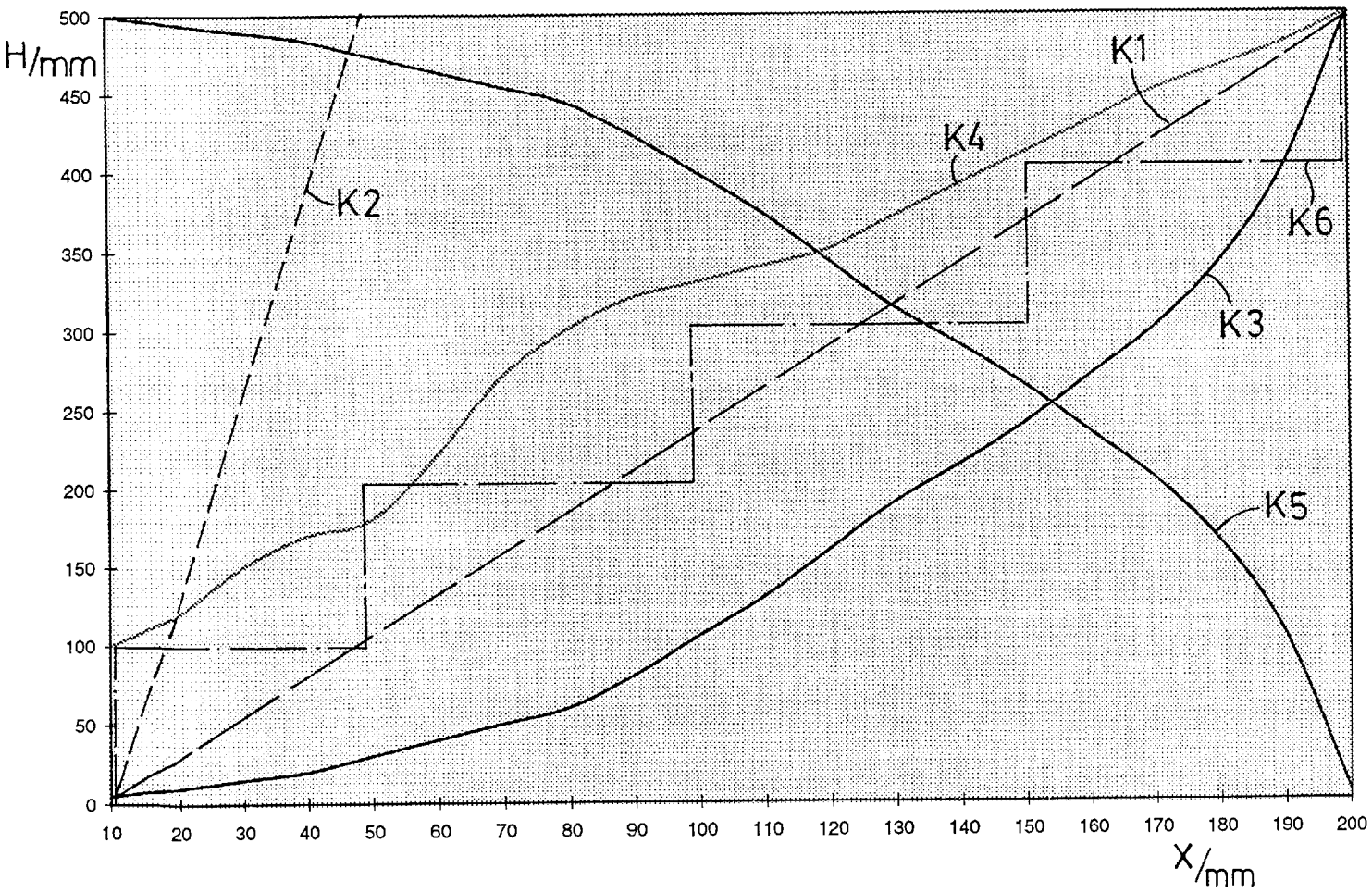
FIG. 4 is a graph showing various characteristic functions for the tensioning.

Based on FIG. 4, the great possibilities of variation can be illustrated and it can be explained to which extent tensioning in dependence on the height of the object takes place with the aid of the subject matter of the invention.

FIG. 4 is based on the fact that for the purpose of tensioning, the tensioning length x of the looping strap 7 is fixed as a parameter in the characteristic function. The "tensioning length x" means the length by which the tightening roller 15 pulls the strap 7 in the direction of the arrow 25 of FIG. 3 after the strap 7 has been withdrawn with the aid of the pair of driving rollers 11.

The height H of the object 4, 5 to be looped is communicated via the ultrasonic sensor 19 to the control unit 23. If the tensioning device 10 works for instance on the basis of the characteristic function K1, then, with the height H of the object increasing, the tensioning length x grows up to a maximum of 200 mm for an object height of 500 mm. Such a continuous linear function is suitable for instance for a stack of newspapers 4 (FIG. 1), since stacks of newspapers will become the more compressible the higher they are, a great tensioning length thus being necessary for the strap 7 to be tightly tensioned.

Softer tensioning is used in the case of the characteristic function K2 equally of linear ascent, the maximum tensioning length x only amounting to 50 mm for an object height of 500 mm.

The characteristic functions K3 and K4 reflect continuous characteristic functions which are, however, not linear; they have been found through tests for optimal looping in dependence on a product and can be entered into the memory unit. For instance, the characteristic function K4 exhibits a special aspect which consists in that the tensioning length x is minimal in the case of an object height of less than 100 mm.

The characteristic function K5 is a continuous function, the ascent of which is opposite to the characteristic functions K1 to K4. Again, this can be the result of a special treatment necessary for the product to be looped which requires only a minor tensioning length x for great stacking heights H, whereas a very long tensioning length x is chosen for very low objects. If for instance high stacks of very little compressible products and low stacks of very soft products are handled in one and the same looping machine in a "mixed operation", then the characteristic function K5 can be used.

In order to restrict the quantity of data which is to be controlled by the control and memory unit 23, 24 and to admit correspondingly simpler designs of these units 23, 24, use can be made of step functions for the characteristic function, as roughly outlined by the characteristic function K6 in FIG. 4. In the case of this characteristic function, a tensioning length x of 10 mm is used for an object height ranging from 0 to 100 mm, a tensioning length x of 50 mm for an object height ranging from 100 to 200 mm, a tensioning length x of 100 mm for an object height ranging from 200 to 300 mm, and so forth. As can further be derived from the above explanations, also a kind of object recognition can be performed by the aid of the looping machine according to the invention and its height detection device. If for instance five different objects are handled on a looping machine, such as cardboxes having contents of varying weight and which differ from each other by their height, then the ultrasonic sensor can carry out an object recognition by way of the height detection device. A certain value for a tensioning length can be allocated to each object, ensuring optimal tensioning for this object. Looping straps of cardboxes are mentioned by way of example, which serve as a safeguard to keep the box closed. If a small, but heavy object is packed, a great tensioning length must be used in spite of the low height. If light-weight objects are accommodated in voluminous boxes, a reduced tensioning length will do in spite of the greater height of the box.

Further—as seen in FIG. 3—the control unit 23 is coupled with the motor control 14 for the pair of driving rollers 11 so that the operating time for the pair of driving rollers is adapted to the height of the product, the looping time for each object thus being optimized. If a high object is recognized, then the pair of driving rollers 11 is put into operation by the motor control 14 only for a short time, after which proper tensioning can take place. In the case of a lower object, a longer operation of the pair of driving rollers 11 will be necessary for the looping strap to be placed around the object prior to proper tensioning.

Finally, FIG. 3 illustrates an interface system 26, by the aid of which the data on the height of an object obtained by the height detection device 18 are transmitted to other external equipment.

What is claimed is:

1. A looping machine for looping objects comprising a machine frame (2), a work table (3) arranged on the machine frame (2), a strap guiding frame (6) disposed on the work table (3) for fitting a looping strap (7) as a loose loop around the object to be looped (4, 5) which is disposed on the work table (3) within the strap guiding frame (6), an insertion device (11) under the work table (3) which inserts the looping strap (7) into the strap guiding frame (6), a withdrawal device (11) under the worktable (3) which withdraws the looping strap (7) from the strap guiding frame (6) and fits the looping strap (7) around the object (4, 5) to be looped, and a tensioning device (10) under the work table (3) which tightens the looping strap (7) around the object (4,5), and a height detection device (18) above the work table (3) for the object (4, 5) to be looped, which comprises a sensor (19) of non-contact operation which detects an object height (H) of the object (4, 5), and a control unit (23) coupled therewith with the tensioning device (10) which adjusts tensioning in dependence on the object height (H), and a memory unit (24) which stores at least one characteristic function (K1 to K6) of tensioning in dependence on the object height (H), the control unit (23) for each tightening action accessing the characteristic function (K1 to K6) in the memory unit (24) which adjusts tensioning.

2. A looping machine according to claim 1, wherein as tensioning, a tensioning length (x) of the looping strap (7) is fixed as a parameter in the characteristic function (K1 to K6).

3. A looping machine according to claim 1, as tensioning, a tensioning force acting on the looping strap (7) is fixed as a parameter in the characteristic function.

4. A looping machine according to claim 1, wherein the characteristic function (K1 to K5) is a continuous function.

5. A looping machine according to claim 1, wherein the characteristic function (K6) is a step function.

6. A looping machine according to claim 1, wherein the sensor (19) is an ultrasonic sensor.

7. A looping machine according to claim 1, wherein the sensor (19) is disposed in an upper horizontal stanchion (20) of the strap guiding frame (6).

8. A looping machine according to claim 1, comprising an interface (26) to input a signal representative of the object height (H).

9. A looping machine according to claim 1, wherein the height detection device (18) is coupled with the withdrawal device (11, 14, 18) to adapt a withdrawal control of the looping strap (7) to the object height (H).

10. A looping machine according to claim 1, wherein object recognition is achieved by means of the height detection device (18).

11. A looping machine for looping objects comprising a machine frame (2), a work table (3) arranged on the machine frame (2), a strap guiding frame (6) disposed on the work table (3) for fitting a looping strap (7) as a loose loop around the object to be looped (4, 5) which is disposed on the work table (3) within the strap guiding frame (6), an insertion device (11) under the work table (3) which inserts the looping strap (7) into the strap guiding frame (6), a withdrawal device (11) under the worktable (3) which withdraws the looping strap (7) from the strap guiding frame (6) and fits the looping strap (7) around the object (4, 5) to be looped, and a tensioning device (10) under the work table (3) which tightens the looping strap (7) around the object (4, 5), and a height detection device (18) above the work table (3) for the object (4, 5) to be looped, which comprises a sensor (19) of non-contact operation which detects an object height (H) of the object (4, 5), and a control unit (23) coupled therewith with the tensioning device (10) which adjusts tensioning in dependence on the object height (H), and a memory unit (24) which stores at least one characteristic function (K1 to K6) of tensioning in dependence on the object height (H), the control unit (23) for each tightening action accessing the characteristic function (K1 to K6) in the memory unit (24) which adjusts tensioning, wherein as tensioning, a tensioning length (x) of the looping strap (7) is fixed as a parameter in the characteristic function (K1 to K6).

12. A looping machine according to claim 11, as tensioning, a tensioning force acting on the looping strap (7) is fixed as a parameter in the characteristic function.

13. A looping machine according to claim 11, wherein the characteristic function (K1 to K5) is a continuous function.

14. A looping machine according to claim 11, wherein the characteristic function (K6) is a step function.

15. A looping machine according to claim 11, wherein the sensor (19) is an ultrasonic sensor.

16. A looping machine according to claim 11, wherein the sensor (19) is disposed in an upper horizontal stanchion (20) of the strap guiding frame (6).

17. A looping machine according to claim 11, comprising an interface (26) to input a signal representative of the object height (H).

18. A looping machine according to claim 11, wherein the height detection device (18) is coupled with the withdrawal device (11, 14, 18) to adapt a withdrawal control of the looping strap (7) to the object height (H).

19. A looping machine according to claim 11, wherein object recognition is achieved by means of the height detection device (18).

* * * * *